United States Patent [19]

Kern

[11] 4,281,498

[45] Aug. 4, 1981

[54] SUSPENDED WOODBEAM CEILING

[76] Inventor: Gilbert G. Kern, 515 N. Victory Blvd., Burbank, Calif. 91502

[21] Appl. No.: 28,904

[22] Filed: Apr. 10, 1979

[51] Int. Cl.[3] ..... E04B 5/52

[52] U.S. Cl. ..... 52/780; 52/665; 52/732

[58] Field of Search ..... 52/DIG. 8, 665, 730, 52/732, 484, 313, 483, 780

[56] References Cited

U.S. PATENT DOCUMENTS

| | | | |
|---|---|---|---|
| 377,685 | 2/1888 | Momberg | 52/313 |
| 598,702 | 2/1898 | Gander | 52/731 |
| 1,671,113 | 5/1928 | Hormes | 52/730 |
| 2,035,964 | 3/1936 | Hormes | 52/313 |
| 2,710,679 | 6/1955 | Bibb | 52/484 |
| 3,202,077 | 8/1965 | Lee | 52/484 |
| 3,241,280 | 3/1966 | Kreuzer | 52/DIG. 8 |
| 3,444,801 | 5/1969 | Lambert | 52/731 |
| 3,690,243 | 9/1972 | Lambert | 52/484 |
| 3,783,771 | 1/1974 | Hartzell | 52/484 |
| 4,019,300 | 4/1977 | Sauer | 52/484 |

FOREIGN PATENT DOCUMENTS

| | | | |
|---|---|---|---|
| 2308407 | 10/1974 | Fed. Rep. of Germany | 52/730 |
| 2340101 | 2/1975 | Fed. Rep. of Germany | 52/313 |

*Primary Examiner*—James A. Leppink
*Assistant Examiner*—Henry E. Raduazo
*Attorney, Agent, or Firm*—Bernard P. Drachlis

[57] ABSTRACT

The suspended woodbeam ceiling is formed of a plurality of beams which lie spaced from each other and at right angles from each other to receive drop-in ceiling panels therebetween. Each beam comprises a beam center to which is secured a beam side on each side thereof. Each beam side has a lip which is engaged by the drop-in ceiling panel for the support of the panel. Crossbeams have locking blocks formed thereon for engaging on and locking on the main beam. The beam contours and textures provide especially aesthetic appearance.

10 Claims, 4 Drawing Figures

SUSPENDED WOODBEAM CEILING

BACKGROUND

This invention is directed to a suspended ceiling construction wherein each beam is made of wood or of simulated wood.

Many commercial buildings have overhead air-conditioning, duct work, pipes and electrical wiring. A suspended ceiling is positioned therebelow to provide a ceiling for the personnel space. The suspended ceiling is often in the shape of an inverted T-bar which is hung on wires from the overhead. Drop-in ceiling panels lie on the crossbars of the T. This permits ready removal of the panels to execute repairs to the overhead equipment.

Some older homes have high ceilings, and it is desirable to install a suspended ceiling therein. Other older homes have plaster ceilings which require extensive repair. In such cases, a suspended ceiling is desirable. In such installations, a suspended woodbeam ceiling is aesthetically attractive.

SUMMARY

In order to aid in the understanding of this invention, it can be stated in essentially summary form that it is directed to a suspended woodbeam ceiling wherein a beam of woodlike appearance is configured to be suspended to interengage and lock with other similar ceiling beams and to receive and support drop-in ceiling panels.

It is thus an object of this invention to provide a suspended woodbeam ceiling construction which is aesthetic so that it can be employed in locations where an attractive suspended woodbeam ceiling is desirable. It is another object to provide a woodbeam ceiling construction wherein a beam is formed of a center and two sides, each made of wood or simulated wood so that the sides present lips for the support of drop-in ceiling panels. It is another object to provide crossbeams which extend between and engage with suspended main ceiling beams so that the crossbeams lock with and maintain separation of the main beams.

Other objects and advantages of this invention will become apparent from a study of the following portion of the specification, the claims, and the attached drawings.

DESCRIPTION OF THE PREFERRED EMBODIMENT

Figure 1:
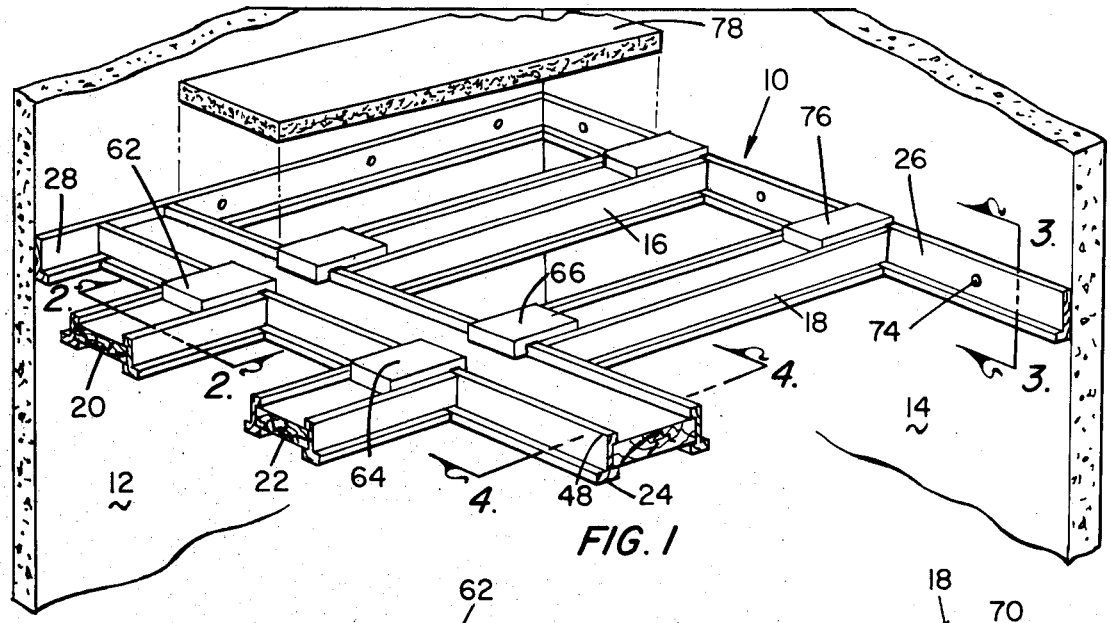
FIG. 1 is an isometric view of a suspended woodbeam ceiling in accordance with this invention, with parts broken away and parts taken in section, and showing a drop-in ceiling panel in projected position.

FIG. 1 shows the suspended woodbeam ceiling 10 of this invention as being positioned in a room having walls 12 and 14. The walls intersect at a right angle and enclose a space for personnel below ceiling 10 and a space above the ceiling. The upper space contains conventional electrical, lighting, plumbing, as well as heating, cooling and ventilation equipment. In FIG. 1, the walls of the room are broken away. In the usual room, there are two other walls, and the ceiling 10 extends to those two other walls. Ceiling 10 in FIG. 1 generally comprises a plurality of crossbeams 16, 18, 20 and 22. Crossbeams 20 and 22 are broken away in FIG. 1. FIG. 1 also shows main beam 24 and wall hangers 26 and 28.

Figure 2:
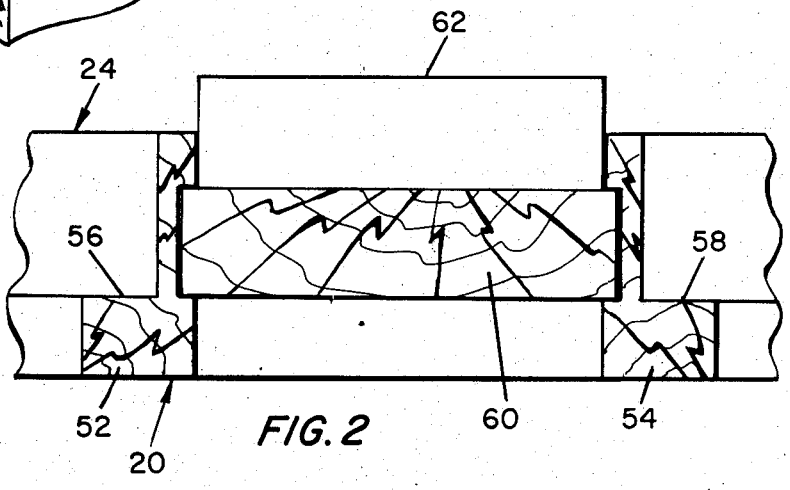
FIG. 2 is an enlarged section taken generally along the line 2—2 of FIG. 1, with parts broken away.
Figure 3:
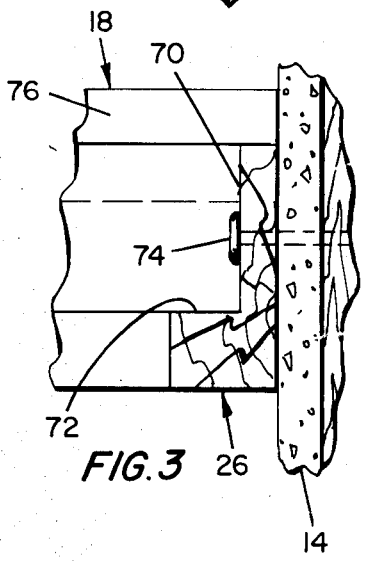
FIG. 3 is an enlarged section taken generally along the line 3—3 of FIG. 1, with parts broken away.
Figure 4:
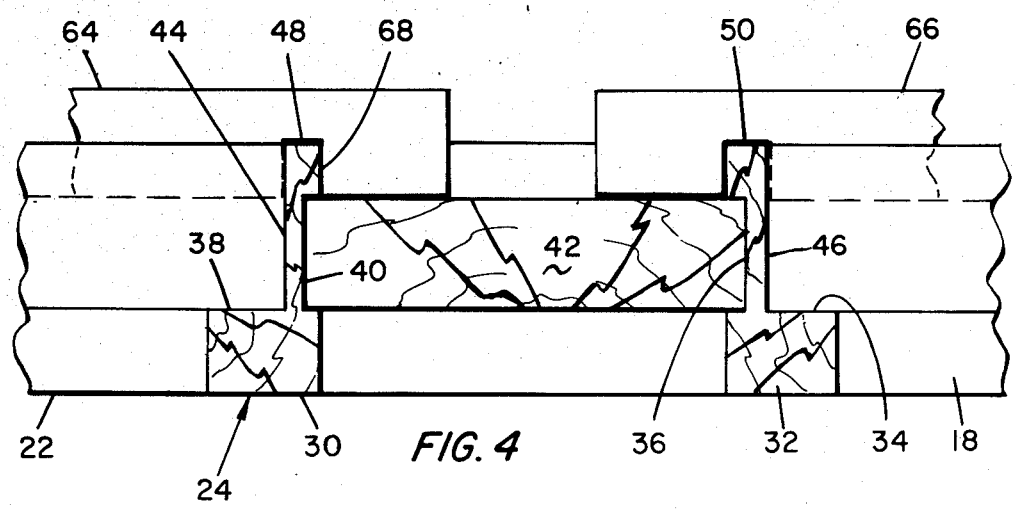
FIG. 4 is an enlarged section taken generally along the line 4—4 of FIG. 1, with parts broken away.

Crossbeam 20 is shown in enlarged cross-section in FIG. 2, while wall hanger 26 is shown in enlarged cross-section in FIG. 3, and main beam 24 is shown in enlarged cross-section in FIG. 4.

Main beam 24 has beam sides or side members 30 and 32 which are each formed in an L-shape to provide a lip 34 on the outside surface above the lower face of the beam side. The inside surface is rabbeted at 36 with the lower edge of rabbet 36 in line with lip 34. These structural elements are shown with respect to beam side 32 in FIG. 4. A similar lip 38 and rabbet 40 are formed in beam side 30. When the beam sides are assembled with rabbets facing each other, beam center 42 is engaged in the rabbets. The structure comprised of beam sides 30 and 32, together with beam center 42, is permanently assembled and is considered a main beam. As seen in FIG. 1, main beam 24 extends the entire distance along the length of the room, from one wall to the other, except for the short length provided by the thickness of the opposing wall hangers. Main beam 24 is supported from the overhead by means of wires engaged with respect to the main beam, such as through screweyes screwed down into the top center of beam center 42. Since the wood beam ceiling of the present invention has much greater strength than the standard T-bar suspended ceiling, the number of suspension wires necessary for the installation of the wood beam ceiling is greatly reduced.

In the preferred embodiment, each of the main beams, crossbeams and wall hangers is preferably made of wood, and in such a case, the three elements of the main beam are glued together and may have additional fastening means. In an alternative embodiment, the main beam may be extruded of thermoplastic, synthetic polymer composition material, and, in such a case, it is preferably configured and colored to resemble wood.

Crossbeams 20 and 22, as well as other crossbeams and main beams, have the same cross-section as main beam 24. The rabbets 36 and 40 in beam sides 32 and 30 provide a secure attachment of the beam center 42. While the bottom of the rabbet, as seen in FIG. 4, is in line with lips 34 and 38, such is not necessary. However, it is preferred because of its decorative and ornamental appearance. With such dimensions, the bottom of beam center 42 is in the same plane as the drop-in ceiling panels which rest on lips 34 and 38. Additionally, it must be noted that the upstanding flanges 44 and 46 extend upward past the top of beam center 42 to form locking lips 48 and 50.

As is seen in FIGS. 1 and 2, crossbeam 20 has the same cross-section as main beam 24 in FIG. 4. It has beam sides 52 and 54 which are L-shaped with an upstanding flange. The beam sides have lips 56 and 58. Furthermore, the beam sides have rabbets on the facing sides of the upstanding flanges into which is inserted beam center 60.

Mounted on top of beam center 60 between the upstanding, locking lips of the upstanding flanges is locking block 62. Locking block 62 is secured in place as by nailing and gluing. Locking block 62 has a rabbeted transverse slot under the end thereof to receive locking lip 48. Similar slots are formed in each of the locking blocks, including locking blocks 64 and 66 seen in FIGS. 1 and 4. Locking block 64 has a rabbeted slot 68 which is the same size as locking lip 48 so as to longitudinally lock crossbeam 22 with respect to the transverse direction of main beam 24. Each of the other locking blocks has a similar slot to provide for locking the crossbeams onto the main beam. The beam sides and beam center of the crossbeams terminate against the outside of the upstanding flanges of the beam sides. The lower portion of the beam sides of the crossbeam are cut back to accommodate the lip on the main beam, see FIG. 1. The crossbeams can be lifted straight up and lifted off of the main beam and can be dropped straight down to join against and lock onto the main beam. When locked in place, the upper surfaces of the lips lie in the same plane.

Wall hanger 26 is seen in FIGS. 1 and 3, and it comprises an L-shaped section the same as the beam sides without the rabbet for the beam center. Thus, wall hanger 26 has upstanding flange 70 which lies against the wall and has lip 72 which lies in the same plane as all the other lips. Wall hanger 26 is secured to the wall, as by nail 74 which extends through upstanding flange 70 into the material of the wall. Locking block 76 is shorter than the locking blocks which engage on the main beam, because it cannot extend over past the top of upstanding flange 70. However, it is rabbeted to receive the top of upstanding flange 70. Thus, locking block 76 cannot act in tension, but, when the entire suspended woodbeam ceiling is in place, the ceiling is engaged against opposite walls so that only compression attachment is necessary. An advantage of this invention is that it is not necessary to make locking block 76 differently from locking blocks 64 or 66. When a beam is terminated at a wall hanger, a standard locking block such as 64 may be converted to locking block 76 simply by cutting the end portion of the locking block 64 back to the rabbeted slot 68. In the preferred embodiment, the beam structure and locking blocks are made of wood, and the cutting of the locking block to engage a wall hanger is easily accomplished.

In placing the suspended woodbeam ceiling in a room, the wall hangers are first put in place with the lips thereon in a single horizontal plane at the desired height. Thereupon, the main beams are placed with tension support from the overhead, if required. Wires from the overhead through screweyes attached in the top of the beam center provide adjustable support. In this way, the ceiling panel support lips lie in a single plane. As the main beams are placed, crossbeams are placed to properly laterally locate the main beams. The lower faces of all the beams also lie in a plane. Drop-in ceiling panels, such as ceiling panel 78 in FIG. 1, are dropped into the openings defined by the wall hangers, crossbeams and main beams. In each case, the lips are in the same plane so that the drop-in ceiling panel rests thereon and defines the ceiling closure. In such cases, the ceiling panels may be translucent so that a light above the suspended woodbeam ceiling shines therethrough. In this way, a decorative and strong suspended woodbeam ceiling is achieved with the opportunity that it may be fit into a room of any convenient and appropriate size.

Drop-in ceiling panels come in standard dimensions, the most common of which is 2 feet by 4 feet. With these standard dimensions, the beams and crossbeams of the present invention can be mass-produced in standard lengths to reduce the cost of production. When it is necessary to have a non-standard length due to the room size, the standard beams and crossbeams can be easily cut to the proper dimension. When a standard length beam or crossbeam is cut to fit the room, a locking block can be easily attached to the top of the cut end of the beam or crossbeam to provide the necessary supporting structure.

As an example of particular dimensions which provide an excellent appearing beam for a suspended woodbeam ceiling, the beam center 42 can be $2\frac{3}{4}$ inches from side-to-side and rabbeted into the beam sides for a depth of $\frac{1}{8}$ inch. When the upstanding flanges, for example flange 44, is $\frac{1}{4}$ inch thick and lip 34 is $\frac{1}{2}$ inch wide, then the lower face of the beam side can be $\frac{3}{4}$ inch across. The thickness from the lower face of the lip can be $\frac{1}{2}$ inch, with the upstanding flange $1\frac{1}{8}$ inch high. These dimensions provide a beam structure which can be economically cut from available stock sizes and can provide a beam structure which is of generous proportions for such use, but is not too bulky for decorative balance.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A unitary beam for a suspended beam ceiling structure, said beam comprising:

first and second beam side members each of said beam side members being L-shaped, said beam side members each having an upwardly facing lip and having a downwardly directed face, and said faces lying in a plane;

a beam center between said beam side members and attached to said beam side members and maintaining said beam side members in a spaced relationship, said beam center having a downwardly directed beam center being spaced above said plane of said faces substantially the same distance as said upwardly facing lips of said beam side members are spaced above said plane;

said beam center being made of wood and said beam side members each being made of wood, said beam side members each being rabbeted with said beam center extending into said rabbets and being secured to both of said beam side members within said rabbets whereby said beam is a unitary structure so that said lips are maintained in the same plane.

2. A suspended beam ceiling structure having at least two beams, one of said beams being a main beam and the other of said beams being a cross beam, each of said beams having first and second beam sides, each of said beam sides being L-shaped, and each of said beam sides having an upwardly facing lip and having a downwardly directed face, said faces of said beam sides of each of said beams lying in a plane;

a beam center between said beam sides and attached to said beam sides and maintaining said beam sides in a spaced relationship, said beam center having a downwardly directed lower surface which lies above said plane, said beam center and said beam sides each being made of wood and said beam center being attached to both said beam sides, each of said beam sides having an upstanding flange extending above said lip and above said beam center, said cross beam being configured for endwise joining against the side of said main beam with said plane of said faces of said cross beam lying substantially in said plane of said faces of said main beam, and with said beam sides of said cross beam substantially abutting one of said beam sides of said main beam; and locking means attached to said cross beam and engaging over and around said upstanding flange on said beam side of said main beam against which said beam sides of said cross beams abut.

3. The suspended beam ceiling structure of claim 2 wherein said locking means is permanently attached to said cross beam and is detachably engaged around the top of said upstanding flange on said beam side adjacent said cross beam and is engaged interiorly of said upstanding flange so that said locking means extends toward said beam center so that said cross beam is detachably attached to said main beam.

4. The suspended beam ceiling of claim 2 wherein said locking means is a locking block secured to said cross beam and said locking block engages upon said main beam to lock said crossbeam to said main beam.

5. The suspended beam ceiling structure of claim 4 wherein said locking block is attached to said crossbeam and said locking block has a rabbeted groove therein which engages over said upstanding flange of said main beam to lock said cross beam to said main beam.

6. The beam of claim 2 wherein said beam center is spaced above said plane and is rabbeted into both of said beam sides.

7. The beam of claim 6 wherein said beam center is spaced above said face substantially the same distance as said lips are spaced above said plane.

8. A suspended woodbeam ceiling structure comprising:

a main beam having a lower face for lying in a ceiling plane and having a pair of oppositely directed lips positioned above said ceiling plane, said main beam being made of wood;

a plurality of crossbeams, each of said crossbeams having a lower face for lying in the ceiling plane and each of said crossbeams having a pair of oppositely directed lips positioned above said ceiling plane, said crossbeams having locking means thereon for locking with said main beam, said crossbeams being made of wood;

said main beam and said crossbeams each having the same cross-section, each of said beams being formed of a pair of spaced beam sides, each having an upstanding flange extending above said lip and each having its lip extending outward away from each other, each of said beam sides being made of wood, an inwardly directed rabbet in each of said beam sides positioned away from said face substantially the same distance as said lips and a wooden beam center positioned in and secured in said rabbets in said beam sides so that said beam side and beam center are secured together as an integral beam structure;

said locking means being secured to said crossbeams and extending over the adjacent upstanding flange of said main beam and toward said wood beam center of said main beam to retain both said beam sides of said crossbeam adjacent the beam side of said main beam to detachably engage each crossbeam on its adjacent main beam and support each crossbeam from its adjacent main beam; and a wall hanger, said wall hanger being L-shaped and having a lower face for lying in said ceiling plane and having a lip thereon, said wall hanger being for securing to a wall and said wall hanger being made of wood, at least one of said beams engaging against said wall hanger and resting on said lip of said wall hanger to support said beam, said beams and said wall hanger being positioned so that said lower surfaces of said main beam, said crossbeams and said wall hanger are in the same plane and said lips of said main beam, said crossbeams and said wall hanger are in the same plane so that a drop-in ceiling panel can rest on said lips.

9. The suspended woodbeam ceiling structure of claim 8 wherein said locking means on said crossbeam is a locking block positioned on said beam center and between said upstanding flanges on said crossbeam and said locking block has a slot therein to engage over said upstanding flange on said main beam.

10. The suspended woodbeam ceiling structure of claim 9 wherein another locking block is positioned on said crossbeam where said crossbeam engages said wall hanger, said locking block adjacent said wall hanger being positioned on said beam center of said crossbeam and extending over said wall hanger.

* * * * *